US006234193B1

(12) United States Patent
Hobbs et al.

(10) Patent No.: US 6,234,193 B1
(45) Date of Patent: May 22, 2001

(54) DUAL DRAIN OUTLET BOX

(76) Inventors: Billy J. Hobbs, 1938 Pinto Cir., Gardnerville, NV (US) 89410; Philip A. Mulvey, 625 N. Shore Dr., Hastings, NE (US) 68901; Jerry P. Mitchell, 38404 E. Pink Hill Rd., Oak Grove, MO (US) 64075; Sam H. Howe, 3654 Cindys Trail, Carson City, NV (US) 89705; Charles T. Crisman, 955 Kennedy Dr., Carson City, NV (US) 89706

( * ) Notice: Subject to any disclaimer, the term of this patent is extended or adjusted under 35 U.S.C. 154(b) by 0 days.

(21) Appl. No.: 09/618,858

(22) Filed: Jul. 18, 2000

Related U.S. Application Data

(63) Continuation of application No. 09/290,359, filed on Apr. 12, 1999, now Pat. No. 6,125,881.

(51) Int. Cl.[7] ..... F16L 5/00

(52) U.S. Cl. ..... 137/360; 312/292; 312/242; 4/287; 4/191

(58) Field of Search ..... 137/360; 4/287, 4/191; 312/242, 229

(56) References Cited

U.S. PATENT DOCUMENTS

| | | | | |
|---|---|---|---|---|
| 2,952,271 | | 9/1960 | Dick et al. | 137/360 |
| 3,831,624 | * | 8/1974 | Doumany | 137/360 |
| 3,834,781 | * | 9/1974 | Logsdon | 312/229 |
| 4,069,837 | | 1/1978 | Jirasek | 137/360 |
| 4,158,471 | | 6/1979 | Logsdon | 312/229 |
| 4,410,004 | | 10/1983 | Kifer et al. | 137/360 |
| 4,564,249 | * | 1/1986 | Logsdon | 312/229 |
| 4,637,422 | | 1/1987 | Izzi, Sr. | 137/360 |
| 4,716,925 | | 1/1988 | Prather | 137/360 |
| 4,865,072 | | 9/1989 | Logsdon | 137/360 |
| 4,934,410 | * | 6/1990 | Humber | 137/360 |
| 5,029,606 | | 7/1991 | Kuhlthau, Jr. | 137/360 |
| 5,169,122 | | 12/1992 | Sunderland | 251/148 |
| 5,305,785 | | 4/1994 | Humber | 137/360 |
| 5,558,119 | | 9/1996 | Condon et al. | 137/360 |
| 5,566,708 | | 10/1996 | Hobbs, Jr. | 137/360 |
| 5,983,923 | * | 11/1999 | Hobbs et al. | 137/360 |

FOREIGN PATENT DOCUMENTS

| | | |
|---|---|---|
| 0 085 329 A2 | 8/1983 | (EP) . |
| 0 085 329 B1 | 8/1983 | (EP) . |
| 0 085 329 B2 | 8/1983 | (EP) . |
| 0 490 854 A2 | 6/1992 | (EP) . |

OTHER PUBLICATIONS

Oatey Company Product Brochure, 11/93.
LSP Plumbing Specialties Product Brochure, 01/95.
IPS Corporation Plumbing Product Price List/Catalog, 01/96.

* cited by examiner

*Primary Examiner*—A. Michael Chambers
*Assistant Examiner*—Thomas L. McShane
(74) *Attorney, Agent, or Firm*—Monty L. Ross, Esq.; Locke Liddell & Sapp LLP

(57) ABSTRACT

Improved outlet boxes are provided for installation in a wall to connect water supply lines and drain lines to the corresponding lines from an appliance. Molded plastic outlet boxes having dual drains; left-to-right reversibility; adaptability to multiple drain and inlet line configurations, including top, bottom and side inlets; inclined bottom walls with gutters and removable webs facilitating drainage; and rear walls with recesses accommodating flushable water supply line connections are disclosed. Dual drain connectors adapted to combine the flows from dual drain outlets into a single drain pipe and knock-outs with downwardly extending, elongated tabs are also disclosed.

10 Claims, 6 Drawing Sheets

DUAL DRAIN OUTLET BOX

This is a continuation of Ser. No. 09/290,359, filed Apr. 12, 1999, now U.S. Pat. No. 6,125,881.

BACKGROUND OF THE INVENTION

1. Field of the Invention

This invention relates to boxes of the type that are typically recessed into walls for use in installing valves and drain lines for appliances such as washing machines, ice machines, and the like. More particularly, this invention relates to a molded plastic outlet box with dual drain outlets that is adapted for use in connecting valves and drain lines in different positions depending upon the configuration and relative positioning of water supply lines and drain pipes plumbed into a wall.

2. Description of Related Art

Molded plastic outlet boxes have previously been made with knockouts disposed in various locations for installation and use with various plumbing configurations. Thus, for example, U.S. Pat. No. 4,410,004 discloses a molded plastic outlet box having three positions for selected use with a drain line disposed between two inlet lines.

U.S. Pat. No. 4,564,249 discloses in one embodiment a molded plastic outlet box useful with a single lever washing machine valve that permits the attachment of a drain line on either side of the two inlet lines connected to the single valve. This patent also discloses a lift-up tab on the drain knockout that is useful for reducing the likelihood of dropping the knockout into the drain line following pressure testing during installation.

U.S. Pat. No. 4,4637,422 discloses a molded plastic outlet box with reversible mounting positions for selective use with downwardly or upwardly extending water pipes.

U.S. Pat. No. 4,716,925 discloses a molded plastic outlet box with a removable, reversible base member containing two adjacent inlet apertures and a single outlet aperture, the idea being that the base can be selectively reversed depending upon whether the in-wall drain line is to the left or right of the hot and cold water inlet lines.

U.S. Pat. No. 4,865,072 discloses a molded plastic outlet box with three aperture positions in the bottom wall, each position having knockouts to facilitate use with either an inlet or drain line, thereby permitting a drain line to be disposed between or on either side of the inlet lines.

U.S. Pat. No. 4,934,410 discloses a molded plastic box with dual drain outlets wherein two inlet line positions are disposed between two outlet line positions, thereby permitting selective attachment to a drain line disposed on either side of the two inlet lines. Means for simultaneously connecting two drain lines to the two drain line positions are not disclosed.

U.S. Pat. No. 5,558,119 discloses an outlet box having two inlet line positions in the bottom wall and a cylindrical sleeve in the back wall for receiving a horizontal drain line from a P-trap.

Notwithstanding the outlet boxes previously disclosed, there remains a need for a molded plastic outlet box that is adaptable for use in situations where drain lines from two different appliances are plumbed into a single outlet box, regardless of the relative positioning of the two drain lines to the water inlet lines. Dual drain outlets may be needed, for example, where a dishwasher drain line or an ice maker condensate line is plumbed to an outlet box that is also used for supplying water to and draining water from a clothes washing machine. An outlet box is also needed that will combine flows from two separate drain outlets into a single drain line. An outlet box is also needed that will accommodate the attachment of water inlet valves through the back wall of the box to flexible inlet lines behind the box without exceeding the total depth of a conventional in-wall installation. An outlet box is also needed that combines dual drain outlets with inlet ports in both the top and bottom walls of the box. Finally, a molded plastic outlet box is also needed that will reduce the likelihood of dropping a knockout plug into a drain line and simultaneously provide drainage for water that leaks or overflows inside the box.

SUMMARY OF THE INVENTION

Outlet boxes are disclosed herein that are useful for connecting in-wall water supply and drain pipes to appliances. The outlet boxes of the invention are adapted to be recessed into a wall and are preferably made of molded plastic such as high impact polystyrene or another similarly effective moldable polymeric resin.

One outlet box disclosed herein comprises in both the top and bottom walls molded ports with knockouts for up to three inlet lines and two drain lines. Ports with knockouts are provided in both the top and bottom walls so that the box can, if needed, be rotated 180 degrees during installation to accommodate situations where the drain pipe is installed on either side of, or between, water supply lines. A Y-connector is also disclosed for use in combining the flows from both drain ports into a single drain pipe beneath the box if desired.

Another outlet box disclosed herein comprises four ports in the bottom wall, each port having knockouts to facilitate connection to either an inlet line or drain line as desired. This structure will allow connection to two inlet lines and either one or two drain lines in any order. Novel flange structures are disclosed for use on the bottom of the outlet box to permit attachment of a one-piece, molded connector for combining flows from two side-by-side drain ports if desired.

Another outlet box disclosed herein comprises two drain ports in the bottom wall and two inlet ports in the back wall for use with angle-stop valves connected to supply lines disposed behind the back wall.

Another outlet box disclosed herein comprises a stepped-down bottom wall having a transversely extending drain gutter across the front of the box and knockout members in the bottom wall. The knockout members are circular sections having a downwardly extending elongated tab that, when removed, forms an elongated vertical slot in the vertical portion of the stepped bottom wall. This elongated slot preferably extends downwardly to a position at or near the lowest portion of the stepped-down bottom wall and desirably provides a drain flow path from the transverse gutter to a drain outlet. The novel knockout member serves two-fold purpose of preventing the knock-out portion from falling into the drain pipe and draining water that accidentally leaks or overflows into the outlet box.

According to another embodiment of the invention, a dual drain outlet box is provided that comprises side-by-side drain outlets with inlet valves connected through either the top or bottom walls of the enclosure.

According to another preferred embodiment of the invention, a dual drain outlet box is provided that comprises a sloped or inclined bottom wall adapted to drain leaked, spillage or overflow water forwardly into a transverse gutter. Drain outlet knockouts in the bottom wall are preferably defined by circumferentially extending, thinned, severable webs and most preferably comprise an upwardly facing protrusion that can be grasped by pliers to facilitate removal during installation. Removal of a knockout provides access to the top edge of a substantially vertical tab that is also defined by thinned wall sections. This tab can also be removed to establish fluid communication between the transverse gutter and a drain outlet. Another distinctive feature of the subject knockout is that it has a outside diameter greater than the inside diameter of the underlying drain outlet port, thereby preventing the knockout from accidentally falling into and partially plugging a drain line during installation.

According to yet another preferred embodiment of the invention, a molded, wall-mounted outlet box is provided for use in connecting angle-stop or in-line valves to potable water supplies and connecting drains to appliances, the outlet box having a recessed section in its back wall to facilitate connection to in-wall water supply lines, particularly flexible connector hoses, within the depth restrictions of a conventional wall.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
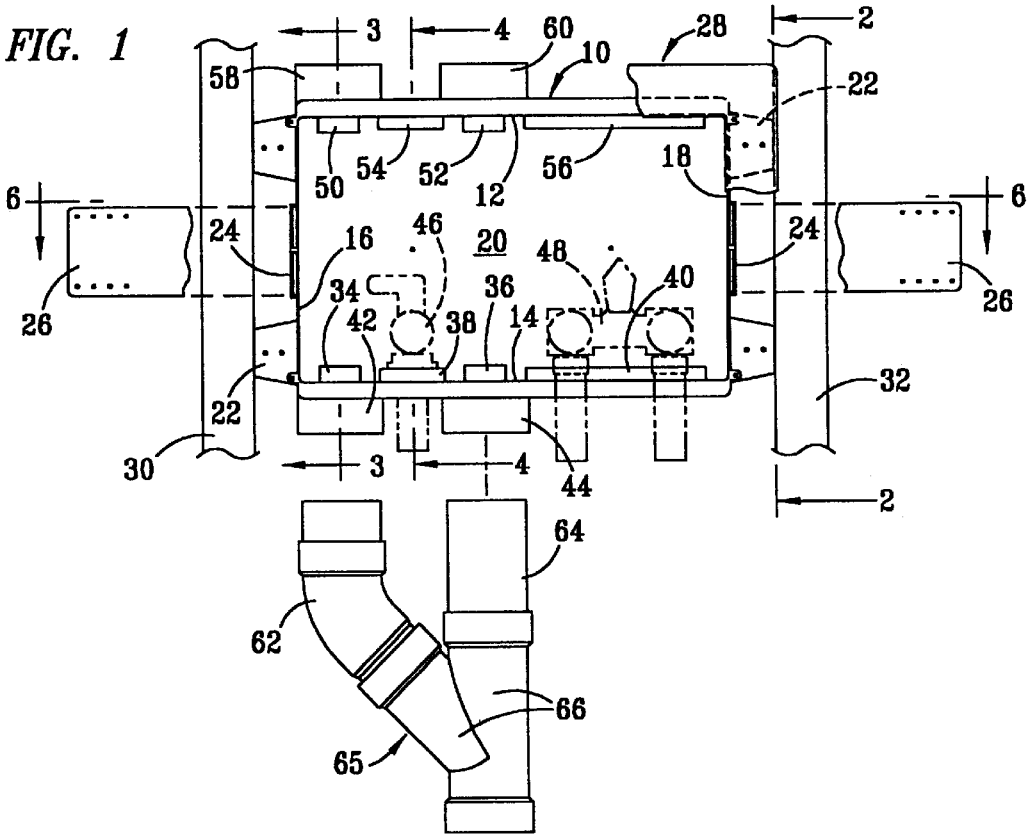
FIG. 1 is an exploded front elevation view, partially broken away, of one embodiment of the outlet box of the invention and a Y-connector for combining flows from two spaced-apart drain ports, with inlet faucets being shown in phantom outline inside the box.

Referring to FIGS. 1–4 and 6, outlet box 10 preferably comprises top wall 12, bottom wall 14, left side wall 16, right side wall 18 and back wall 20. Outlet box 10 is preferably molded, such as by injection molding, from a suitable moldable polymeric resin such as, for example, high-impact polystyrene. Ears 22 can be molded directly onto side walls 16, 18 if desired for use in attaching outlet box 10 to wall studs as discussed below in relation to FIG. 7. Alternatively, straps such as molded plastic straps 26 having transversely extending tabs 27, 29 can also be provided for insertion into pockets 24 molded onto side walls 16, 18 of outlet box 10.

Molded faceplate 28 is optionally provided for frictional engagement with outlet box 10 following installation of outlet box 10 into a recess in a wall structure. One such typical wall structure can comprise spaced-apart studs 30, 32 faced with panels of wallboard 76, 78 made of gypsum, drywall, plywood or other similarly useful material. Referring to FIGS. 2–4 and 6, spacer legs 82 desirably project rearwardly from side walls 16, 18 past back wall 20 to provide support against panel 76, and another backing board 80 extending laterally between studs 30, 32 can also be provided to provide additional support to back wall 20 of outlet box 10 if desired. Outlet box 10 is primarily positioned between studs of a wall structure by attachment to in-wall plumbing including water supply lines and drain lines, and is further anchored to the studs by nailing through molded ears 22 or straps 26 attached to outlet box 10. After outlet box 10 is in position within the wall and connected to the in-wall plumbing as appropriate, friction-enhancing members 72 of side wall 70 of faceplate 28 desirably engage tabs 74 of outlet box 10 and outwardly extending flange portion 68 of faceplate 28 overlies the wallboard 78 around outlet box 10.

According to one embodiment of the invention, elevated drain outlet port positions 34, 36 and supply valve port positions 38, 40 are provided in bottom wall 14 and drain outlet port positions 50, 52 and supply valve port positions 54, 56 are likewise provided in top wall 12 of outlet box 10. According to this embodiment of the invention, drain outlet port positions 34, 36 in bottom wall 14 are desirably located opposite drain outlet port positions 50, 52 in top wall 12 and supply valve port positions 38, 40 in bottom wall 14 are located opposite supply valve port positions 54, 56 in top wall 12 so that outlet box 10 can be installed in either of two reversible positions to facilitate connection with water supply lines and drain lines already plumbed into a wall. A particular advantage of the present invention is the provision of dual drain port positions in outlet box 10 to facilitate connection with two appliance drain or condensate lines. Thus, for example, both a condensate line and a washing machine drain hose can be connected to a single in-wall drain line using outlet box 10 of the invention.

As shown in FIG. 1, drain outlet port positions 34, 36 are located so as to facilitate connection with drain pipes 62, 64 of Y-connector 65 located closer to stud 30 than to stud 32. However, were the drain lines located closer to stud 32 than stud 30, the installer could rotate outlet box 10 by 180 degrees and thereby utilize drain outlet port positions 50, 52, which would then be located on the right end, in a bottom-wall position more nearly adjacent to stud 32. Outlet box 10 can be used with either single valves such as valve 46, shown in phantom outline, or with a dual inlet, single lever valve 48, also shown in phantom outline. It will be appreciated, however, that single valves 46 can also be installed in supply valve port position 40 of bottom wall 14 if desired.

Figure 2:
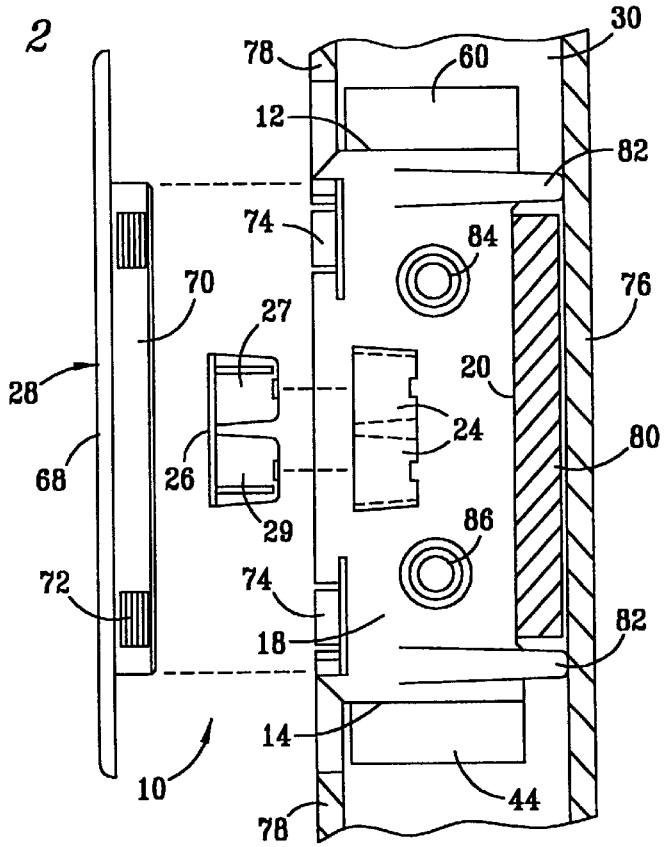
FIG. 2 is an enlarged, exploded, right side elevation view of the outlet box of FIG. 1, as viewed along line 2—2 of FIG. 1.
Figure 3:
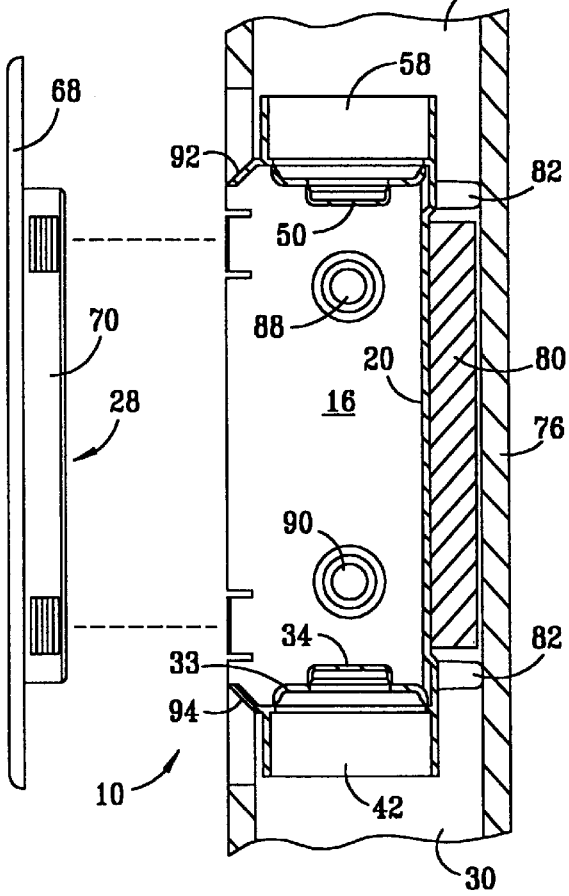
FIG. 3 is an enlarged, exploded, cross-sectional elevation view of the outlet box of FIG. 1, taken along line 3—3 of FIG. 1.
Figure 4:
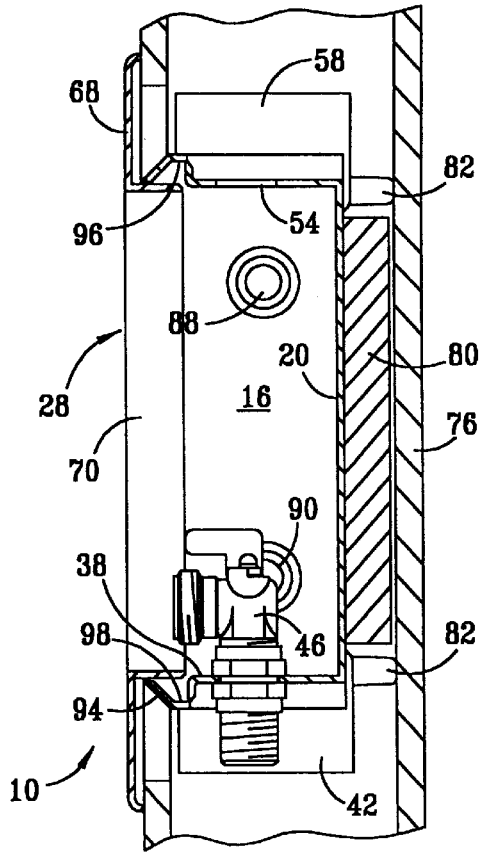
FIG. 4 is an enlarged, cross-sectional elevation view of the outlet box of FIG. 1, taken along line 4—4 of FIG. 1.
Figure 6:
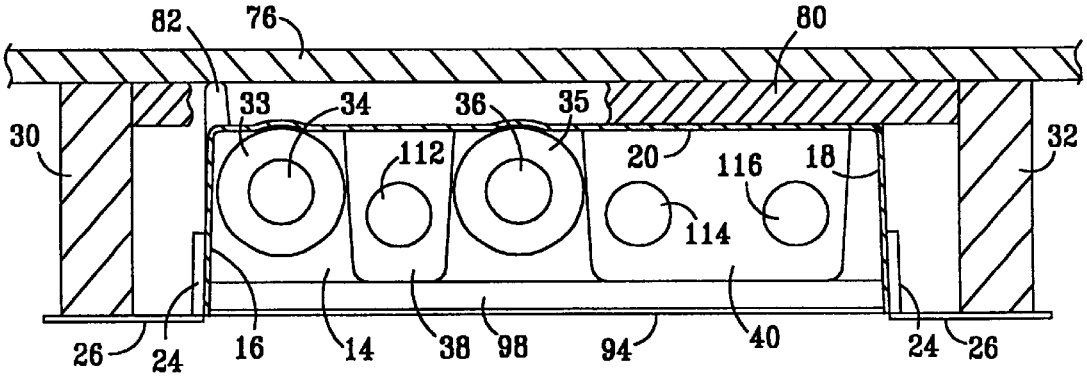
FIG. 6 is an enlarged bottom plan view of the outlet box of FIG. 1, without faucets or Y-connector.
Figure 7:
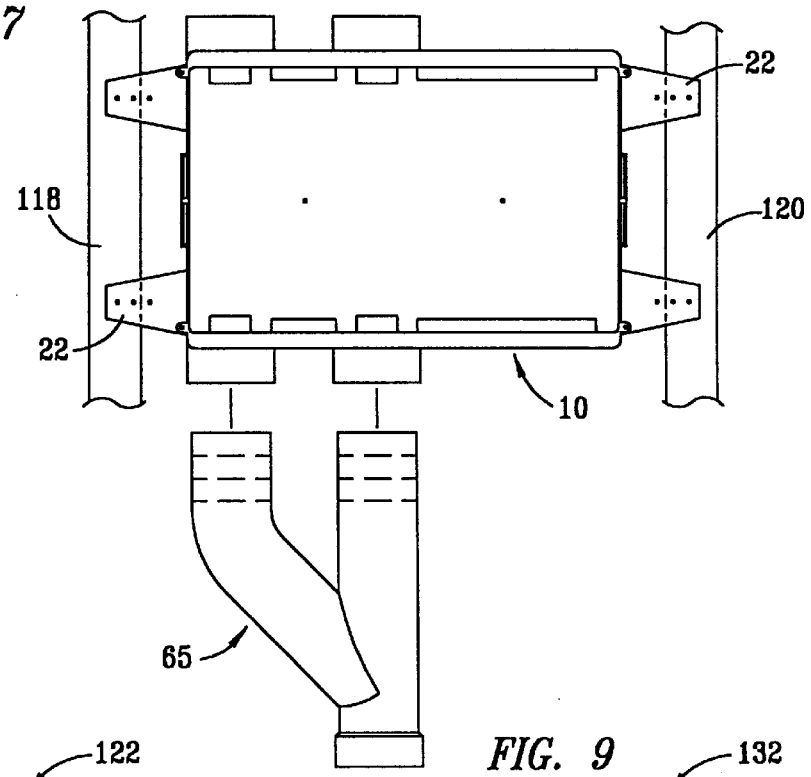
FIG. 7 is a simplified, front elevation view of the outlet box of FIG. 1, but depicting an alternative installation scheme.

Referring to FIG. 6, supply valve port positions 38, 40 preferably further comprise knockouts 112, 114 and 116 for installing supply valves as may be desired. Knockouts 112, 114, 116 are preferably unitarily molded as a part of supply valve port positions 38, 40 of bottom wall 14, with thinned or weakened regions around the circumference that facilitate removal of the knockout portion. Drain outlet port positions 34, 36 preferably further comprise alternate, annular knockout portions 33, 35 for selective use depending upon the diameter of the drain hose or line being connected to the in-wall drain pipe. The diameter of the outermost annular knockout portion 33, 35 will desirably not exceed the diameter of the downwardly extending cylindrical flanges 42, 44 provided in concentric alignment therewith on the bottom surface of the bottom wall to facilitate connection to drain pipes 62, 64 of Y-connector 65. It will be appreciated that individual drain pipes can also be connected to flange members 42, 44 below outlet drain port positions 34, 36, but use of a Y-connector permits flows from two appliance condensate or drain lines to be combined into a single in-wall drain pipe as shown by reference numeral 66 in FIG. 1. Referring to FIGS. 2–4, knockouts 84, 86 in side wall 18 and knockouts 88, 90 in side wall 16 are also provided for the possible insertion of conduits from the side of outlet box 10 if desired.

Referring to FIGS. 3 and 4, front lip 94 defining gutter 98 on the front of outlet box 10 can also be provided if desired. Front lip 92 and gutter 96 are likewise provided at the top of outlet box 10 for use in situations where outlet box 10 is used in a 180 degree reversal from the position shown for reasons as described above.

Figure 5:
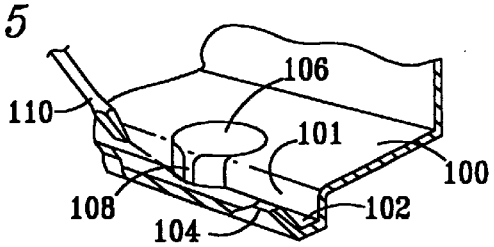
FIG. 5 is a perspective detail view of a novel knockout structure useful in outlet boxes of the invention.

FIG. 5 illustrates another embodiment of the invention wherein bottom wall 100 is molded with a downwardly directed step 101 which, in combination with lip 104, defines a gutter 102. Knockout 106 represents in simplified form the knockout portion of a port position, most preferably a drain outlet port position. Elongated tab 108 serves two desirable functions not provided by conventional knockout tabs. First, it is useful in preventing accidental droppage of knockout 106 into an underlying drain line during installation. Elongated tab 108 can be depressed inwardly by means of a screw driver 110 or other similarly effective tool, after which long-nose pliers can be used to pull knockout 106 upwardly away from bottom wall 100, thereby preventing knockout 106 from falling downwardly into an underlying drain line (not shown). Second, the slot formed when elongated tab 108 and knockout portion 106 are removed from bottom wall 100 provides fluid communication between trough 102 and an underlying drain line to assist in draining water that may leak or overflow into the interior of the outlet box during use.

FIG. 6 depicts another installation of outlet box 10 of the invention wherein ears 22 are used to nail, screw or otherwise fasten outlet box 10 to more closely spaced studs 118, 120. Here again, as previously described, a Y-connector 65 can be used to consolidate flows from two spaced-apart drain outlet port positions into a single drain line.

Figure 8:
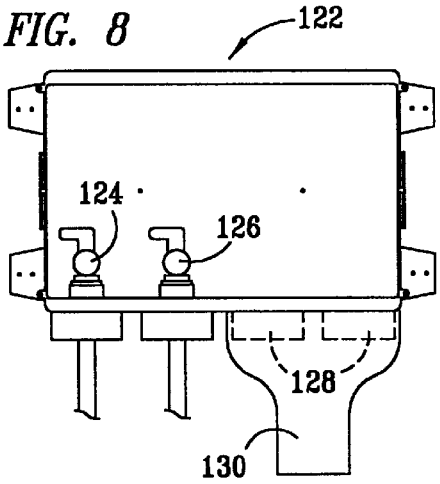
FIG. 8 is a simplified front elevation view of another embodiment of the outlet box of the invention in combination with a one-piece Y-connector installed on side-by-side, dual drain outlets.
Figure 9:
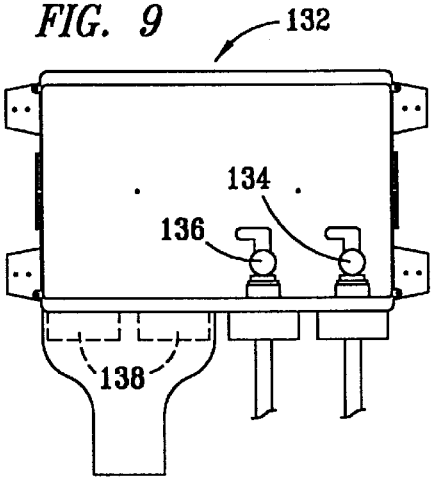
FIG. 9 is a simplified front elevation view of the outlet box of FIG. 8 in combination with the one-piece Y-connector of FIG. 8 installed on side-by-side, dual drain outlets at the opposite side of the outlet box.
Figure 10:
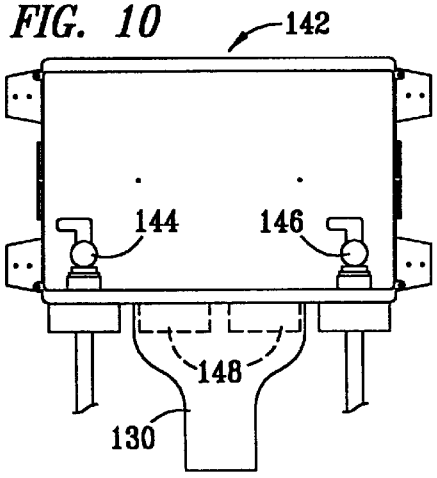
FIG. 10 is a simplified front elevation view of the outlet box of FIGS. 8 and 9 in combination with the one-piece Y-connector of FIGS. 8 and 9 installed on side-by-side, dual drain outlets in the middle of the outlet box, between the inlet valves.

Referring to another embodiment of the invention as disclosed in FIGS. 8–10 of the drawings, three outlet boxes are disclosed that each contain four port positions in the bottom wall. Outlet box 122 of FIG. 8 shows supply valves 124, 126 installed in the first two port positions, with the second two port positions being utilized as drain outlets 128. Outlet box 132 as shown in FIG. 9 is installed with the first two port positions utilized as drain outlets 138 and with supply valves 134, 136 installed in the second two port positions. FIG. 10 discloses outlet box 142 having supply valves 144, 146 installed in the first and last port positions, with the two middle port positions being utilized for drain outlets 148. In any of the embodiments depicted in FIGS. 8–10, each port position is desirably provided with either a single or multiple concentric knockout portions to permit use with tubing, lines or pipes of various diameters.

Figure 12:
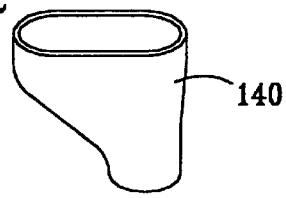
FIG. 12 is a simplified perspective view, taken from above, of an alternative embodiment of the Y-connector of FIGS. 8–11.

In each of FIGS. 8–10 an integrally molded, plastic funnel connector 130 is desirably provided for use in consolidating the flows from two side-by-side drain outlet port positions into a single drain line. Funnel connector 130 is particularly useful where a single drain line is centered between two drain outlet port positions. Alternatively, a different funnel connector 140 as shown in FIG. 12 is preferred for use in situations where two side-by-side drain outlet port positions are disposed so that one or the other port positions directly overlies an in-wall drain line. Funnel connector 140 of FIG. 12 is reversible to permit installation where the drain line underlies either the left or right one of two side-by-side drain outlet port positions. Y-connector 65 and funnel connectors 130, 140 are desirably made of a plastic material that can be attached to the downwardly extending flanges beneath each drain outlet port position by conventional methods such as cementing with a solvent-based adhesive or other similarly effective means.

Figure 11:
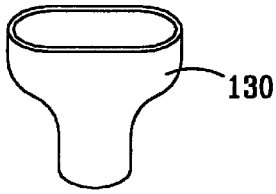
FIG. 11 is a simplified perspective view, taken from above, of the Y-connector of FIGS. 8–10.
Figure 13:
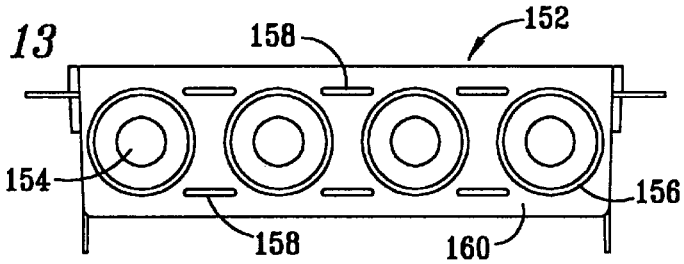
FIG. 13 is an enlarged, simplified, bottom plan view of one embodiment of a bottom wall useful in making the outlet box connection shown in FIGS. 8–10.

FIG. 13 discloses a bottom view of bottom wall 160 of an outlet box 152 having four port positions 154 as described above with each port position being surrounded by a downwardly extending cylindrical flange 156. In accordance with the present invention, any two of the port positions can be utilized for drain outlet connections and the other two port positions can be used for installing supply valves as described in relation to FIGS. 8–10. Projecting flange bosses 158 are desirably positioned between the port positions in tangential relationship to flanges 156 and parallel to each other to provide additional structural support for the attachment of connectors such as the funnel connectors described in relation to FIGS. 11 and 12 where any two side-by-side port positions are used as drain outlet port positions.

Figure 14:
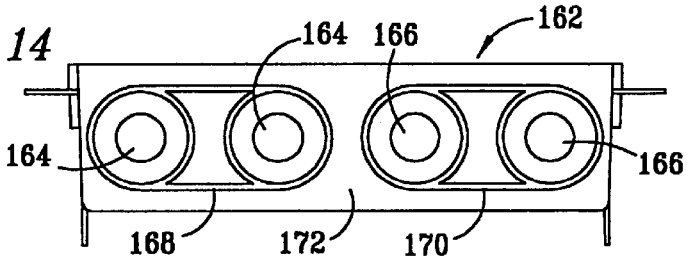
FIG. 14 is an enlarged, simplified, bottom plan view of an another embodiment of a bottom wall useful in making the outlet box connection shown in FIGS. 8 and 9, but not in FIG. 10.

FIG. 14 similarly depicts bottom wall 172 of outlet box 162 wherein the flange members surrounding port positions 164 are interconnected by tangentially extending flange members 168 and the flange members surrounding port positions 166 are interconnected by tangentially extending flange members 170.

Figure 15:
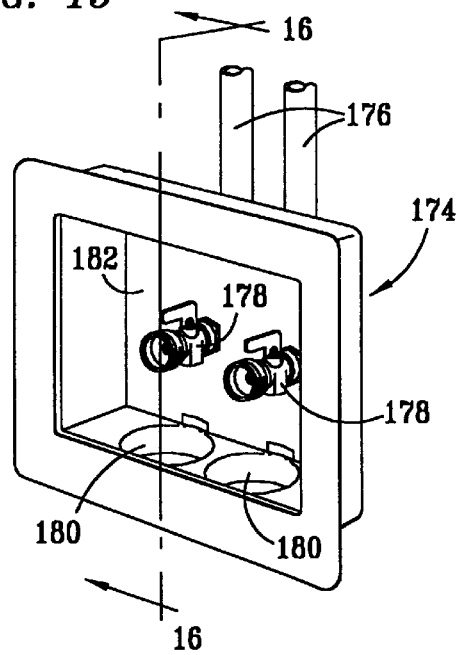
FIG. 15 is a simplified, front perspective view of another outlet box of the invention, having two angle stop valves mounted in the back wall of the box, and two dual drain outlets in the bottom wall of the box.
Figure 16:
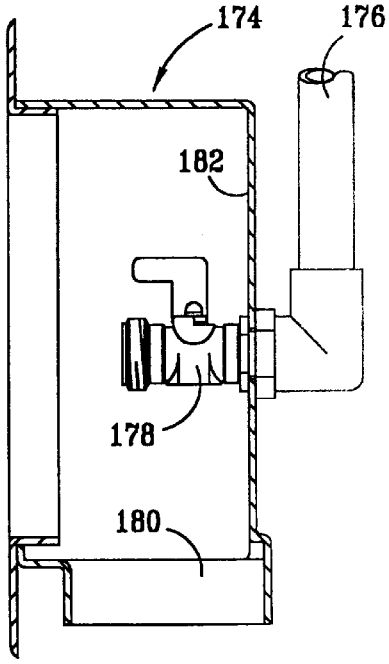
FIG. 16 is an enlarged, cross-sectional side elevation view of the outlet box of FIG. 15, taken along line 16—16 of FIG. 15.
Figure 20:
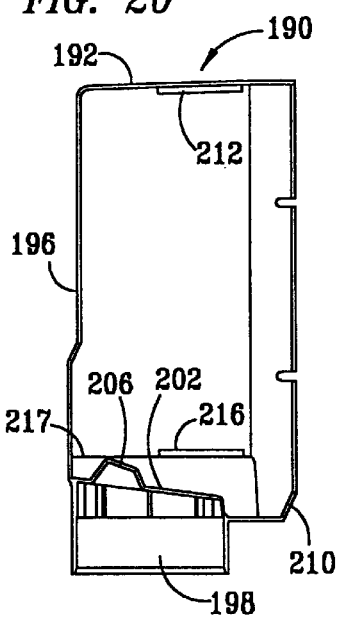
FIG. 20 is a cross-sectional side elevation view taken along line 20—20 of FIG. 17.
Figure 17:
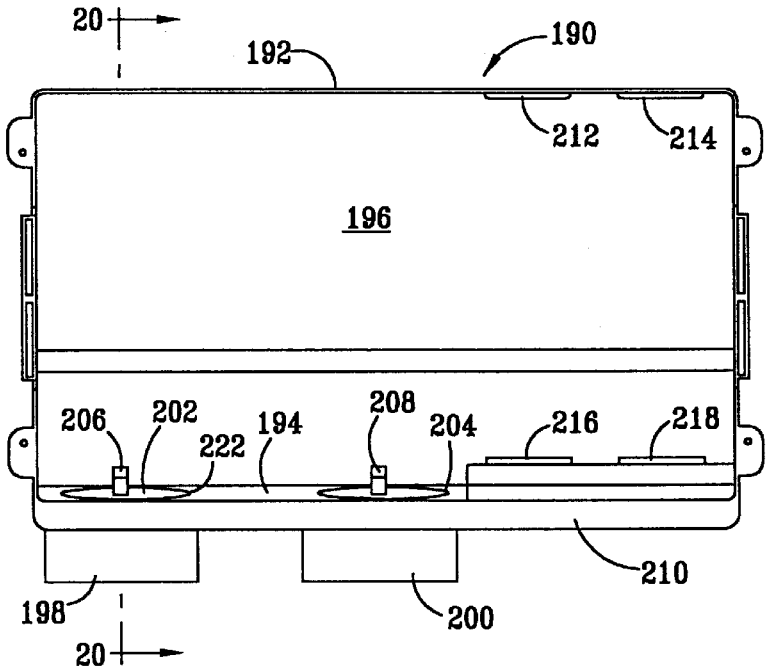
FIG. 17 is a simplified front elevation view of another outlet box having an inclined bottom wall section, knock-outs for dual drain outlets disposed in the inclined bottom wall section, and knock-outs for inlet valve connections disposed opposite the drain outlets in both the top and bottom walls.
Figure 18:
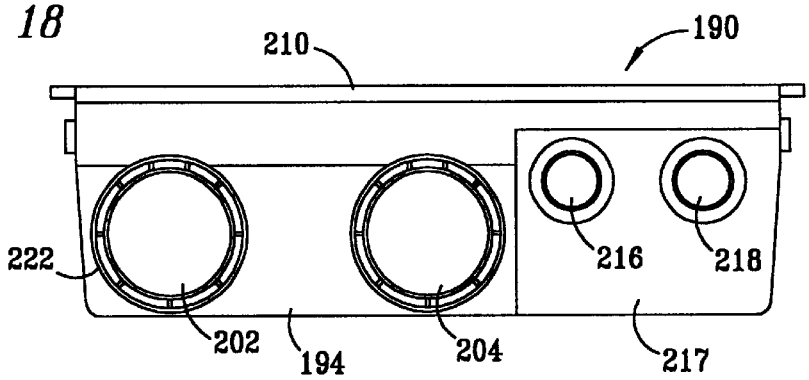
FIG. 18 is a bottom plan view of the dual drain outlet box disclosed in FIG. 17.
Figure 19:
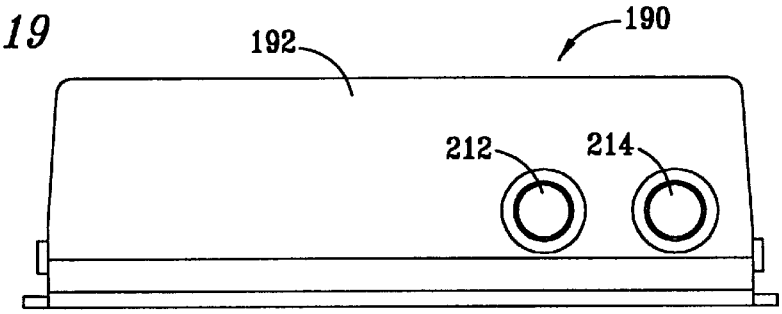
FIG. 19 is a top plan view of the dual drain outlet box of FIG. 17.

FIGS. 15–16 disclose yet another embodiment of the invention having dual drain outlet ports. More particularly, molded outlet box 174 comprises dual drain outlet ports 180 disposed in its bottom wall and two angle stop valves 178 connected to supply pipes 176 through back wall 182. With an installation of this type, it is understood that the combined depth of outlet box 174 and the space occupied by supply lines 176 cannot exceed the overall thickness of the wall in which outlet box 174 is installed if outlet box 174 is to be fully recessed and flush mounted inside the wall.

Through use of the invention disclosed herein, more than one drain or condensate line can now be connected to in-wall plumbing using a single molded plastic outlet box. The number and configuration of supply valve port positions relative to the drain outlet port positions can vary, with the provision of at least two supply valve port positions and two drain outlet port positions being generally preferred. The outlet boxes of the invention can be made with or without troughs in the bottom wall, and where the port positions are not symmetrical or fully interchangeable for use as either supply valves or drain outlets, reversibility is achieved by duplicating the same port positions in the opposite wall. Through use of stepped bottom walls having knockouts with elongated, downwardly extending tabs, it is now possible to safely remove tabs with less risk of droppage into a drain line while simultaneously providing fluid communication between a stepped-down position in the bottom wall and a drain outlet. Through use of Y-connectors and funnel connectors in combination with the outlet boxes as disclosed herein, the flows from either side-by-side or spaced apart outlet drains can be consolidated into a single in-wall drain line. Finally, the dual drain or multiple drain outlet boxes of the invention can be fabricated so as to permit installation with water supply lines entering the outlet boxes from the top, bottom, side or back walls as desired.

Figure 21:
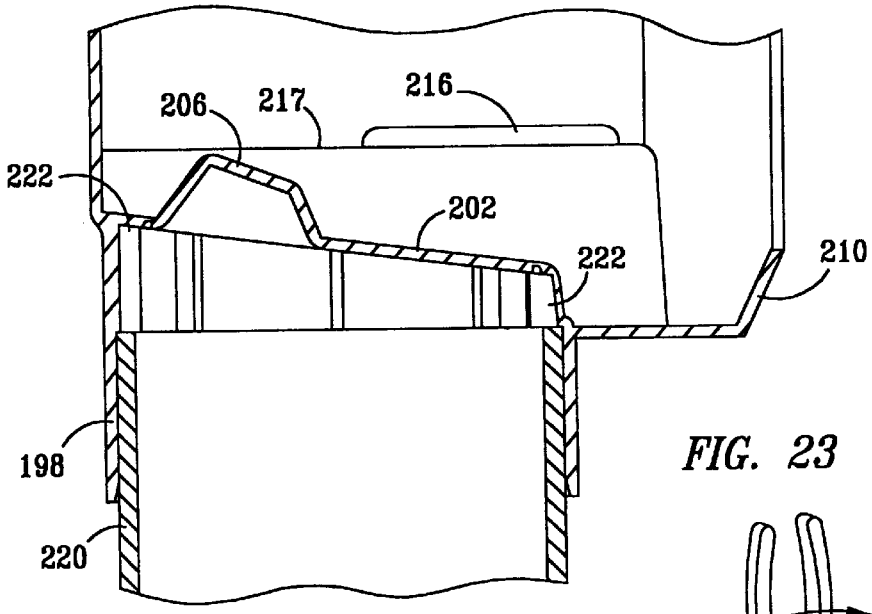
FIG. 21 is an enlarged, detail side elevation view, partially in section, of a drain outlet for an outlet box as depicted, for example, in FIGS. 17–20, the drain outlet having an inclined bottom wall and a novel, removable test cap knock-out, the outlet box being depicted as installed over the end of a drain pipe segment.
Figure 23:
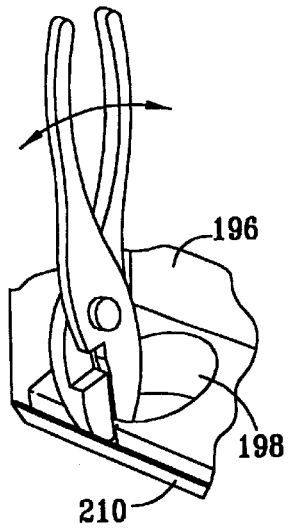
FIG. 23 depicts the outlet box section of FIG. 22 with the test cap knock-out portion removed and with pliers depicted in the position in which they can be used to remove the web separating the drain outlet from the transverse gutter across the bottom wall of the box.
Figure 22:
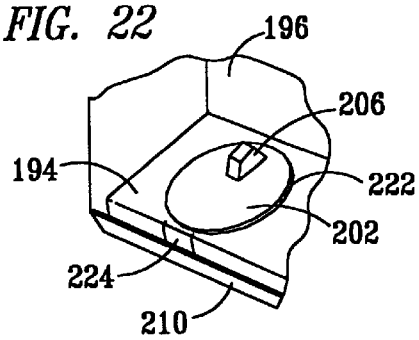
FIG. 22 is a simplified front perspective view of the lower left-hand corner of an outlet box as shown, for example, in FIGS. 17–20, depicting a removable test cap knock-out disposed over a drain outlet port, the test cap knock-out being adjacent to a removable web separating the drain outlet from a transverse gutter member extending across the front edge of the bottom wall of the box.

FIGS. 17–23 depict another preferred embodiment of the invention wherein outlet box 190, preferably made of a moldable plastic material, comprises top wall 192, back wall 196 and an inclined bottom wall section 194 having drain outlet ports 198, 200. Inclined bottom wall section 194 is desirably downwardly inclined from back to front so that any water that is spilled, leaked or that otherwise overflows into outlet box 190 will be directed into transverse gutter 210 running across the front lower edge of the box. Knockouts 202, 204 are desirably disposed over drain outlet ports 198, 200, respectively, and preferably further comprise protrusions 206, 208 that can be grasped by pliers for removal of one or both knockouts 202, 204 as required during installation. Referring to FIGS. 17–18 and 20–22, knockouts 202, 204 are preferably unitarily molded into outlet box 190 and are defined by and connected to inclined bottom wall 194 by circumferentially extending, thinned webs 222 that are fracturable when a pulling force is applied to protrusions 206, 208. Furthermore, the diameter of knockouts 202, 204 is preferably greater than the inside diameter of drain outlet ports 198, 200, or at least greater than the inside diameter of pipe 220 (as shown in FIG. 21) inserted into the downwardly extending flange portion of drain outlet port 198, to prevent knockouts 202, 204 from being accidentally dropped into the drains during their removal from inclined floor section 194 of outlet box 190. Referring to FIGS. 22 and 23, a forwardly facing vertical tab member 224 is also desirably provided adjacent to each drain outlet port and separated by a thinned perimeter web to facilitate removal by pliers or a screwdriver after the removal of knockout 202 , thereby establishing a fluid drain path, for example, from gutter 210 into drain outlet port 198. Outlet box 190 preferably also comprises knockouts 212, 214 for water supply line inlet ports in top wall 196 and opposed knockouts 216, 218 for water supply line inlet ports in bottom pedestal 217 as shown, for example, in FIGS. 17–21.

Figure 24:
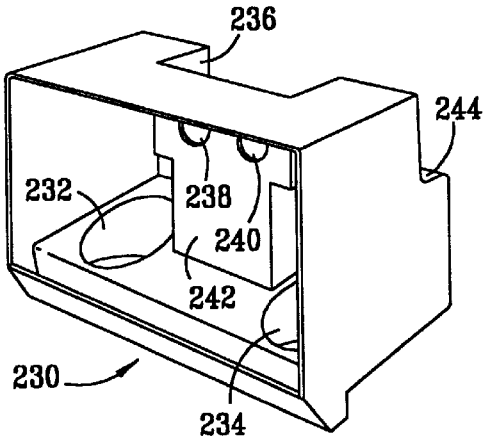
FIG. 24 is a front perspective view of a molded outlet box having a recessed rear wall section adapted to facilitate the attachment of water supply lines through the rear wall.
Figure 25:
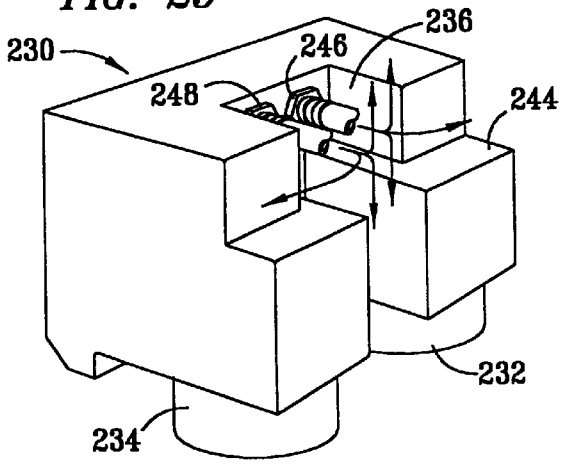
FIG. 25 is a rear perspective view of the outlet box shown in FIG. 24.

Still another preferred embodiment of the invention is described in relation to FIGS. 24 and 25 of the drawings. Referring to FIGS. 24 and 25, a moldable, in-wall outlet box 230 is disclosed that preferably comprises dual outlet drain ports 232, 234, dual water supply line inlet ports 238, 240 disposed in back wall 242, and back-side recesses 236, 240. Back-side recesses 236, 240 facilitate the attachment of water supply lines, such as by fittings 246, 248, through the back wall of outlet box 230 without exceeding the depth restrictions of a conventional wall. Using this outlet box, flexible supply lines can be used to connect angle-stop or in-line valves inside the box to fixed supply lines terminating above, below, or to either side of the box. The spacing between inlet ports 238, 240 in back wall 242 should desirably be sufficient to permit attachment of the valves and also to permit turning the handles to operate the valves between their open and closed positions.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. An outlet box installable in a wall recess for use in connecting water supply valves drain lines of appliances to in-wall plumbing, the box comprising:

top, bottom, left side, right side and back walls, each wall having an inwardly facing surface and an outwardly facing surface;

two supply valve port positions and two drain outlet port positions disposed in the bottom wall; and a funnel connector disposed below the drain outlet port positions.

2. The outlet box of claim 1 wherein each drain outlet port position is surrounded by a molded flange member projecting outwardly from the outwardly facing surface of the bottom wall and wherein the funnel is connected to the flange members.

3. The outlet box of claim 2, further comprising laterally extending, outwardly projecting, reinforcing bosses disposed between the separate flange members.

4. The outlet box of claim 3 wherein the flange members are cylindrical and the bosses are tangentially aligned with the flange members.

5. The outlet box of claim 4 wherein the bosses are parallel to each other.

6. An outlet box installable in a wall recess for use in connecting water supply valves and drain lines of appliances to in-wall plumbing, the box comprising:

top, bottom, left side, right side and back walls, each wall having an inwardly facing surface and an outwardly facing surface;

two supply valve port positions and two drain outlet port positions disposed in the bottom wall; and a Y connector disposed below the drain outlet port positions.

7. The outlet box of claim 6 wherein each drain outlet port position is surrounded by a molded flange member projecting outwardly from the outwardly facing surface of the bottom wall and wherein the funnel is connected to the flange members.

8. The outlet box of claim 7, further comprising laterally extending, outwardly projecting, reinforcing bosses disposed between the separate flange members.

9. The outlet box of claim 8 wherein the flange members are cylindrical and the bosses are tangentially aligned with the flange members.

10. The outlet box of claim 9 wherein the bosses are parallel to each other.

* * * * *

UNITED STATES PATENT AND TRADEMARK OFFICE

CERTIFICATE OF CORRECTION

PATENT NO. : 6,234,193 B1
DATED : May 22, 2001
INVENTOR(S) : Billy J. Hobbs

It is certified that error appears in the above-identified patent and that said Letters Patent is hereby corrected as shown below:

Title page,
Item [76], delete the following inventors:

-- Philip A. Mulvey, 625 N. Shore Dr., Hastings, NE (US) 68901
Jerry P. Mitchell, 38404 E. Pink Hill Rd., Oak Grove, MO (US) 64075
Sam H. Howe, 3654 Cindys Trail, Carson City, NV (US) 89705
Charles T. Crisman, 955 Kennedy Dr., Carson City, NV (US) 89705 --

Signed and Sealed this

Twenty-sixth Day of March, 2002

*Attest:*

*Attesting Officer*

JAMES E. ROGAN
*Director of the United States Patent and Trademark Office*